US012320058B2

(12) United States Patent
Zheng et al.

(10) Patent No.: US 12,320,058 B2
(45) Date of Patent: Jun. 3, 2025

(54) CLOTHES SHAKING APPARATUS AND CLOTHES CARE DEVICE COMPRISING SAME

(71) Applicants: Chongqing Haier Roller Washing Machine Co., Ltd., Chongqing (CN); Haier Smart Home Co., Ltd., Shandong (CN)

(72) Inventors: Xiaoqiu Zheng, Qingdao (CN); Jindong Bing, Qingdao (CN)

(73) Assignees: Chongqing Haier Roller Washing Machine Co., Ltd., Chongqing (CN); Haier Smart Home Co., Ltd., Qingdao (CN)

( * ) Notice: Subject to any disclaimer, the term of this patent is extended or adjusted under 35 U.S.C. 154(b) by 180 days.

(21) Appl. No.: 18/005,443

(22) PCT Filed: Jun. 18, 2021

(86) PCT No.: PCT/CN2021/100943

§ 371 (c)(1),
(2) Date: Jan. 13, 2023

(87) PCT Pub. No.: WO2022/012268

PCT Pub. Date: Jan. 20, 2022

(65) Prior Publication Data

US 2023/0279608 A1 Sep. 7, 2023

(30) Foreign Application Priority Data

Jul. 14, 2020 (CN) ..... 202010675692.5

(51) Int. Cl.

| | |
|---|---|
| ***D06F 73/02*** | (2006.01) |
| ***D06F 57/12*** | (2006.01) |
| ***D06F 87/00*** | (2006.01) |

(52) U.S. Cl.
CPC ..... *D06F 73/02* (2013.01); *D06F 57/12* (2013.01); *D06F 87/00* (2013.01)

(58) Field of Classification Search
CPC ..... D06F 73/02; D06F 57/12; D06F 87/00; D06F 58/12

(Continued)

(56) References Cited

U.S. PATENT DOCUMENTS

| | | | | |
|---|---|---|---|---|
| 9,486,111 | B2 * | 11/2016 | Flannery | A47K 17/022 |
| 2010/0043500 | A1 | 2/2010 | Yoo et al. | |
| 2017/0327306 | A1 * | 11/2017 | Nam | B65D 85/18 |

FOREIGN PATENT DOCUMENTS

| | | | |
|---|---|---|---|
| CN | 103510357 | A | 1/2014 |
| CN | 106149326 | A | 11/2016 |

(Continued)

OTHER PUBLICATIONS

English translation of Liang (CN106149326), https://patents.google.com/patent/CN106149326B/en?oq=106149326, Nov. 23, 2016.*

(Continued)

*Primary Examiner* — Khoa D Huynh
*Assistant Examiner* — Abby M Spatz
(74) *Attorney, Agent, or Firm* — Maier & Maier, PLLC

(57) ABSTRACT

A clothes shaking apparatus and a clothes care device. The clothes shaking apparatus includes a cross beam, a drive member, a cam, a sliding member, and a guide member. The cross beam, the drive member and the guide member are connected to a box body of a care device. An accommodating slot matching the cam is formed on the sliding member. When the drive member drives the cam to rotate, the sliding member is driven to reciprocate and the cross beam is driven to reciprocate, so that clothes hung on the cross beam can shake to remove wrinkles. Moreover, in the reciprocating process of the sliding member, the guide member can guide (Continued)

the sliding member, so that the sliding member moves in a straight line. In this way, under the drive of the cam, the sliding member reciprocates in a straight line, and meanwhile drives the cross beam to reciprocate.

8 Claims, 4 Drawing Sheets

(58) Field of Classification Search
USPC ..... 38/143, 1 A
See application file for complete search history.

(56) References Cited

FOREIGN PATENT DOCUMENTS

| | | | |
|---|---|---|---|
| CN | 107083665 A | | 8/2017 |
| CN | 208440858 U | * | 1/2019 |
| CN | 110438759 A | | 11/2019 |
| CN | 209741511 U | | 12/2019 |
| CN | 111254677 A | | 6/2020 |
| KR | 100524400 B1 | | 10/2005 |

OTHER PUBLICATIONS

English translation of Ye (CN111254677), https://patents.google.com/patent/CN111254677B/en?oq=cn111254677, Jun. 9, 2020.*

English translation of Ma (CN208440858), https://patentimages.storage.googleapis.com/b0/aa/5e/bac4e27849a9be/CN208440858U.pdf, Jan. 29, 2019.*

International Search Report dated Sep. 22, 2021, in International Application No. PCT/CN2021/100943, 6 pages.

* cited by examiner

CLOTHES SHAKING APPARATUS AND CLOTHES CARE DEVICE COMPRISING SAME

FIELD

The present disclosure belongs to the technical field of clothing care, and specifically provides a clothing shaking device and a clothing care apparatus including the clothing shaking device.

BACKGROUND

When the clothing is being washed in a washing machine, the clothing continuously rolls, rotates and entangles with each other in the washing machine, and the clothing will often have some wrinkles thereon after the washing is completed.

In the prior art, wrinkles on the clothing can be removed by using a clothing care apparatus. Chinese patent publication No. CN210420649U discloses a clothing care apparatus, which includes a cabinet, and a clothing shaking device is provided in the cabinet. The clothing shaking device mainly includes a driving motor, a connection member and a cross bar. The driving motor is fixedly connected with the cabinet, and the connection member includes a crank and a connecting rod. An output shaft of the driving motor is connected with a first end of the crank, a second end of the crank is hinged with a first end of the connecting rod, and a second end of the connecting rod is hinged with an upright column on a cross beam. The driving motor can drive the cross beam to reciprocate through the crank and the connecting rod. That is, the motor of the clothing shaking device in the above patent drives the cross beam to reciprocate through the crank and connecting rod mechanism. The clothing can be hung on the cross beam and can be shaken as the cross beam reciprocates, thus removing wrinkles on the clothing. However, when the crank and connecting rod mechanism is moving, there is a quick return phenomenon, which will affect the stability and service life of the shaking device. In addition, it will also produce large noise, thus affecting the user experience.

Chinese patent publication No. CN103510357A discloses a clothing vibrating device, which mainly includes a motor, a cam, an elastic reset mechanism, a slider, a suspension member and a swinging rod. The cam is connected with an output shaft of the motor and rotates with it. Under a joint action of the cam and the elastic reset mechanism, the slider reciprocates to drive the swinging rod to swing, so as to achieve a vibrating effect on the clothing, etc. That is, the clothing vibrating device of the above patent drives the swinging rod to swing through the cam mechanism driven by the motor. However, the slider in the cam mechanism in the above patent needs to realize reciprocating movement by means of the elastic reset mechanism. During operation, the slider will continuously impact the elastic reset mechanism. After a period of use, the elastic reset mechanism will be prone to failure, thus affecting the normal use of the clothing vibrating device.

Accordingly, there is a need for a new technical solution in the art to solve the above problem.

SUMMARY

In order to solve the above problem in the prior art, that is, to solve the problem of clothing wrinkles, the present disclosure provides a clothing shaking device for a clothing care apparatus; the clothing care apparatus includes a cabinet, the clothing shaking device is arranged in the cabinet, and the clothing shaking device includes: a cross beam, which is movably connected with the cabinet, and which is configured to carry clothing hangers or which is provided with clothing hangers; a driving member installed on the cabinet; a cam, which is fixedly connected with a power output end of the driving member; a sliding member, which is provided with a receiving groove matching with the cam, and which is connected with the cross beam; and guide members, which are fixedly connected with the cabinet and can guide the sliding member so that the sliding member can move linearly; the receiving groove is arranged to allow the cam to rotate in the receiving groove, and during the rotation of the cam, the cam always abuts against a side wall of the receiving groove, thus driving the sliding member to reciprocate through the rotation of the cam, and thus driving the cross beam to reciprocate.

In a preferred technical solution of the above clothing shaking device, the sliding member includes: a sliding ring, inner side walls of which enclose the receiving groove; and two sliding columns, which are respectively arranged on both sides of the sliding ring in a direction of the reciprocating movement, and which are slidingly connected with the guide members.

In a preferred technical solution of the above clothing shaking device, the inner side walls of the sliding ring enclose a rectangular hole structure, and the cam abuts against an inner side wall in a width direction of the rectangular hole structure.

In a preferred technical solution of the above clothing shaking device, the inner side walls of the sliding ring enclose an oblong hole structure, and the cam abuts against an inner side wall in a width direction of the oblong hole structure.

In a preferred technical solution of the above clothing shaking device, the guide members are of a plate structure, on which guide holes matching with the sliding columns are arranged.

In a preferred technical solution of the above clothing shaking device, the cross beam is provided with two connecting columns, which are fixedly connected with the two sliding columns respectively.

In a preferred technical solution of the above clothing shaking device, the cam is provided with a hollow part.

In a preferred technical solution of the above clothing shaking device, the cam is an eccentric wheel.

In a preferred technical solution of the above clothing shaking device, both ends of the cross beam are each provided with an elastic connecting arm, and the elastic connecting arms are fixedly connected with the cabinet.

In another aspect, the present disclosure also provides a clothing care apparatus, which includes the clothing shaking device described above.

It can be understood by those skilled in the art that in the preferred technical solutions of the present disclosure, the clothing shaking device includes: a cross beam, which is movably connected with the cabinet, and which is configured to carry clothing hangers or which is provided with clothing hangers; a driving member installed on the cabinet; a cam, which is fixedly connected with a power output end of the driving member; a sliding member, which is provided with a receiving groove matching with the cam, and which is connected with the cross beam; and guide members, which are fixedly connected with the cabinet and can guide the sliding member so that the sliding member can move linearly; the receiving groove is arranged to allow the cam to rotate in the receiving groove, and during the rotation of the cam, the cam always abuts against a side wall of the receiving groove, thus driving the sliding member to reciprocate through the rotation of the cam, and thus driving the cross beam to reciprocate. When the driving member drives the cam to rotate, the sliding member can be driven to reciprocate, and at the same time, the cross beam can be driven to reciprocate, so that the clothing hung on the cross beam can be shaken to remove wrinkles; in addition, during the reciprocating movement of the sliding member, the guide members can guide the sliding member, so that the sliding member can move linearly. In this way, the sliding member reciprocates linearly when driven by the cam, and at the same time, the cross beam is driven to reciprocate. Through such an arrangement, the clothing hangers arranged on the cross beam can be prevented from hitting a back plate of the cabinet or a door provided on a front side of the cabinet. In addition, as compared with the clothing shaking device disclosed in Chinese patent publication No. CN210420649U, the clothing shaking device of the present disclosure does not have a quick return phenomenon during operation, has better stability and longer service life, does not generate large noise, and has a better user experience. As to the clothing vibrating device disclosed in Chinese patent publication No. CN103510357A, the slider in the patent needs to realize reciprocating movement by means of an elastic reset mechanism. During operation, the slider will continuously impact the elastic reset mechanism. After a period of use, the elastic reset mechanism will be prone to failure. However, in the clothing shaking device of the present disclosure, by providing a receiving groove matching with the cam on the sliding member and placing the cam in the receiving groove, the cam can always abut against the side wall of the receiving groove during the rotation of the cam, so as to drive the sliding member to reciprocate. There is no risk of failure of the elastic reset mechanism, the reliability is better, and the service life is longer.

Further, the sliding member includes: a sliding ring, inner side walls of which together enclose the receiving groove; and two sliding columns, which are respectively arranged on both sides of the sliding ring in a direction of the reciprocating movement, and which are slidingly connected with the guide members. By providing the sliding ring to match with the cam and arranging the sliding ring to have a hollow structure, the weight of the sliding member can be effectively reduced as compared with a solid structure, which is advantageous for the rapid reciprocating movement of the sliding member. In this way, a shaking strength of clothing can be increased and the wrinkle removal effect can be improved.

Further, the cam is provided with a hollow part. By providing the hollow part on the cam, the weight of the cam can be effectively reduced, which is advantageous for the high-speed rotation of the cam. In this way, the shaking strength of clothing can be increased and the wrinkle removal effect can be improved.

Further, the cam is an eccentric wheel, which has a simple structure and a low cost.

In addition, the clothing care apparatus further provided by the present disclosure on the basis of the above technical solutions, due to the adoption of the above clothing shaking device, has the technical effects of the above clothing shaking device. As compared with the clothing care apparatus before improvement, the clothing care apparatus of the present disclosure has low noise during operation and has a long service life.

BRIEF DESCRIPTION OF DRAWINGS

Preferred embodiments of the present disclosure will be described below with reference to the accompanying drawings, in which.

DETAILED DESCRIPTION

Figure 1:
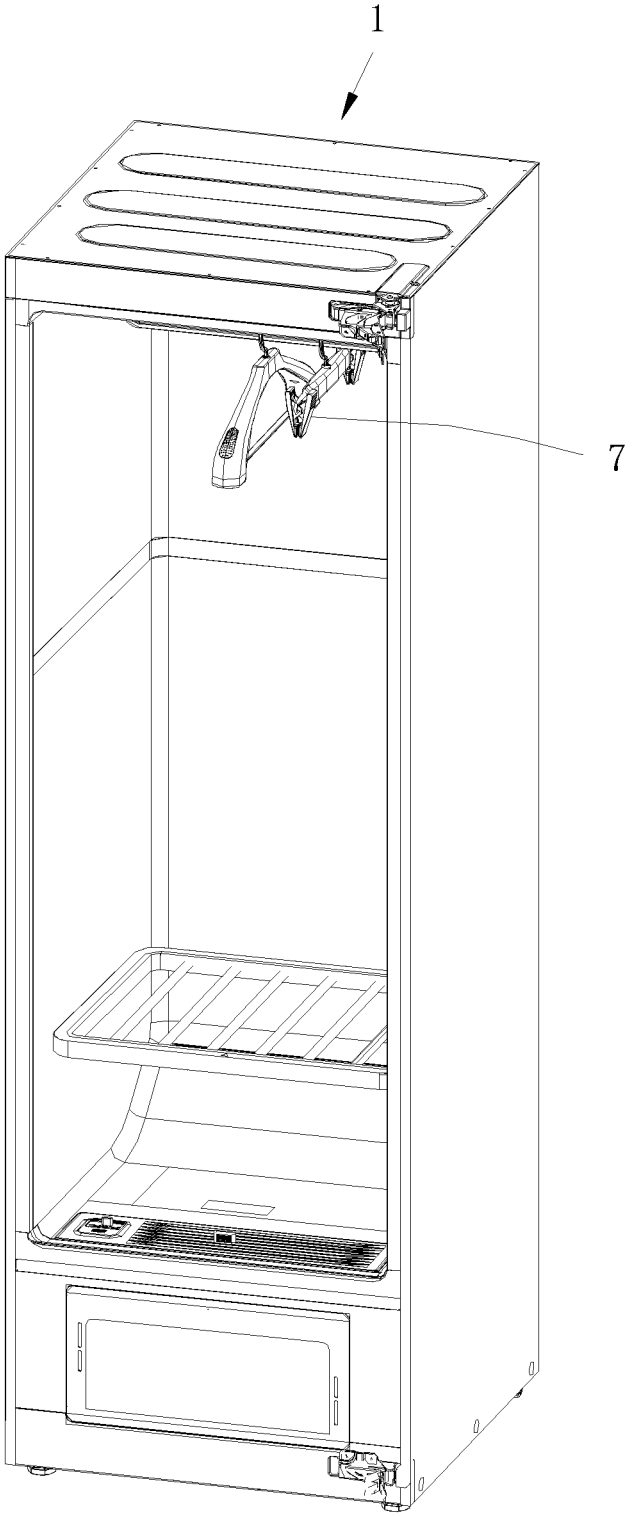
FIG. 1 is a schematic structural view of a clothing care apparatus of the present disclosure.

Preferred embodiments of the present disclosure will be described below with reference to the accompanying drawings. It should be understood by those skilled in the art that these embodiments are only used to explain the technical principles of the present disclosure, and are not intended to limit the scope of protection of the present disclosure. For example, although the various components in the drawings are drawn according to a certain proportional relationship, this proportional relationship is not invariable. Those skilled in the art can adjust it as needed so as to adapt to specific applications. The technical solutions after the adjustment will still fall within the scope of protection of the present disclosure.

It should be noted that in the description of the present disclosure, terms indicating directional or positional relationships, such as "upper", "lower", "left", "right", "inner", "outer" and the like, are based on the directional or positional relationships shown in the accompanying drawings. They are only used for ease of description, and do not indicate or imply that the device or element must have a specific orientation, or be constructed or operated in a specific orientation, and therefore they should not be considered as limitations to the present disclosure. In addition, terms "first" and "second" are only used for descriptive purposes, and should not be interpreted as indicating or implying relative importance.

In addition, it should also be noted that in the description of the present disclosure, unless otherwise clearly specified and defined, terms "arrange", "install", "connect" and "connection" should be understood in a broad sense; for example, the connection may be a fixed connection, or may also be a detachable connection, or an integral connection; it may be a direct connection, or an indirect connection implemented through an intermediate medium, or it may be internal communication between two elements. For those skilled in the art, the specific meaning of the above terms in the present disclosure can be interpreted according to specific situations.

Reference is first made to FIG. 1, which is a schematic structural view of a clothing care apparatus of the present disclosure.

As shown in FIG. 1, the clothing care apparatus of the present disclosure includes a cabinet 1, in which a clothing shaking device is arranged. Users can hang clothing with wrinkles on the clothing shaking device, and then start the clothing care apparatus to care for the clothing and remove wrinkles from the clothing.

Figure 2:
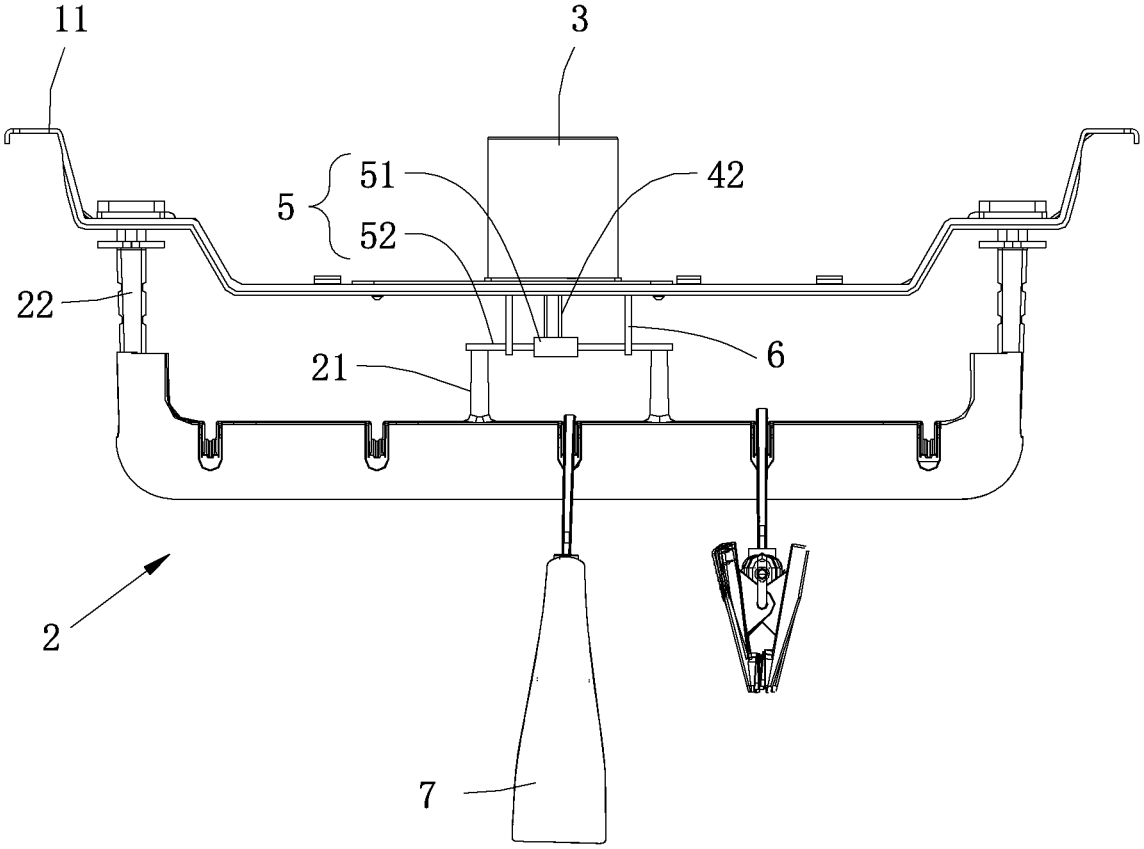
FIG. 2 is a schematic structural view of a clothing shaking device of the present disclosure.
Figure 3:
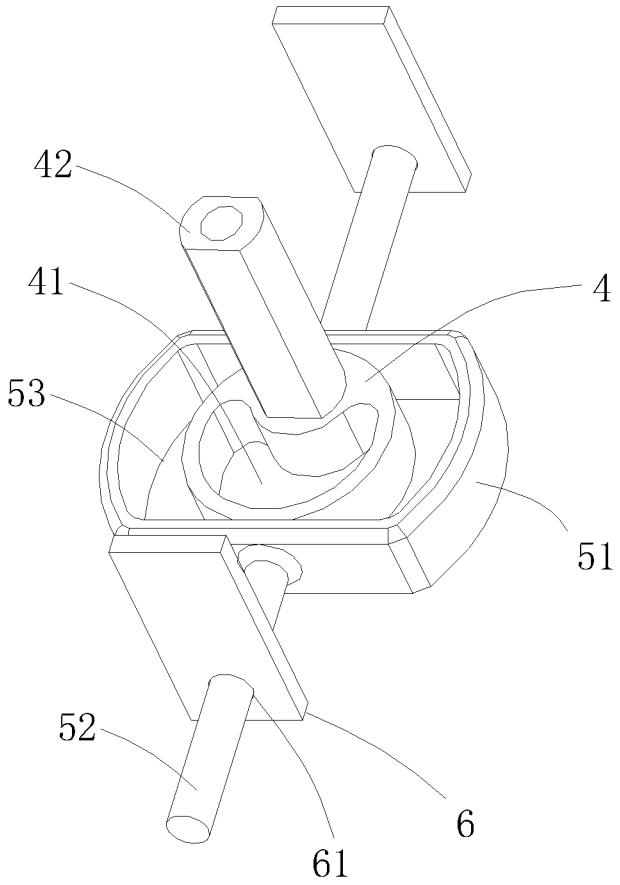
FIG. 3 is a schematic assembly view of a cam, a sliding member and guide members of the clothing shaking device of the present disclosure.
Figure 4:
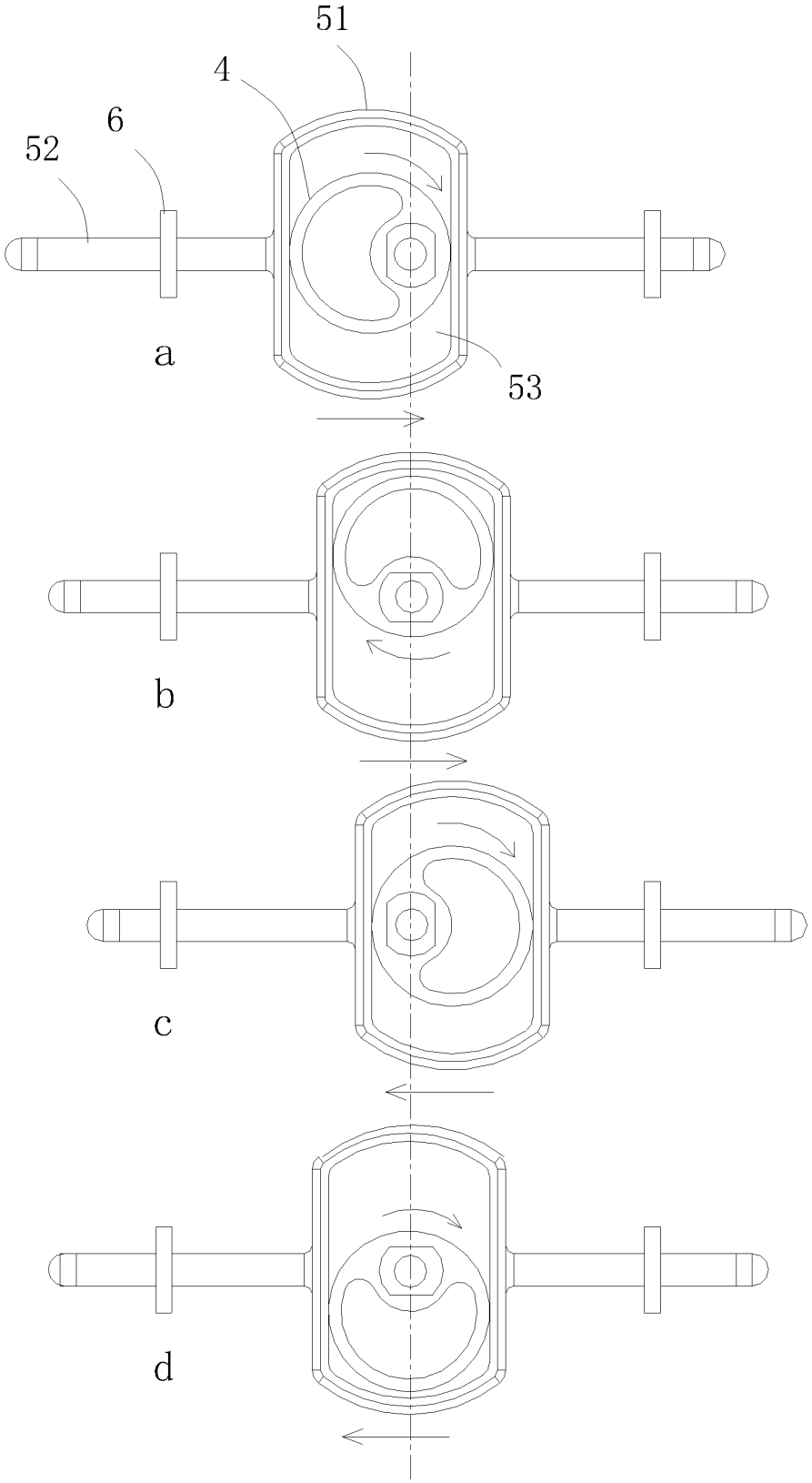
FIG. 4 is a schematic view illustrating a movement principle of the clothing shaking device of the present disclosure.

Next, reference is made to FIGS. 2 to 4, in which FIG. 2 is a schematic structural view of the clothing shaking device of the present disclosure, FIG. 3 is a schematic assembly view of a cam, a sliding member and guide members of the clothing shaking device of the present disclosure, and FIG. 4 is a schematic view illustrating a movement principle of the clothing shaking device of the present disclosure.

As shown in FIGS. 2 to 4, the clothing shaking device of the present disclosure includes a cross beam 2, a driving member 3, a cam 4, a sliding member 5, and guide members 6. In order to facilitate installation of the clothing shaking device, a fixing bracket 11 is arranged in the cabinet 1, and the clothing shaking device is installed on the fixing bracket 11.

With continued reference to FIGS. 2 to 4, the cross beam 2 is movably connected with the fixing bracket 11 so that the cross beam 2 can swing relative to the cabinet 1.

In a preferred embodiment, an elastic connecting arm 22 is arranged at each of both ends of the cross beam 2, and top ends of the elastic connecting arms 22 are fixedly connected with the fixing bracket 11. Since the elastic connecting arms 22 have certain flexibility, the cross beam 2 can move left and right relative to the cabinet 1. The elastic connecting arms 22 can be made of elastic materials such as rubber.

Of course, the cross beam 2 can also be movably connected with the fixing bracket 11 in other ways. For example, a rigid connecting arm can be arranged at each of both ends of the cross beam 2, and a long-strip-shaped slide groove can be arranged at each of both ends of the fixing bracket 11. The slide grooves are arranged in a length direction of the cross beam 2, and top ends of the connecting arms are arranged in the slide grooves. When the clothing care apparatus is running, the connecting arms can slide left and right along the slide grooves, so that the cross beam 2 can move left and right relative to the cabinet 1.

It should be noted that by using the elastic connecting arms 22 to connect the cross beam 2 with the fixing bracket 11, rigid collision with the fixing bracket 11 can be avoided, which can not only prevent the possible deformation of various members caused by collision, but also can avoid generation of loud noise.

The cross beam 2 is configured to carry clothing hangers 7, or some clothing hangers 7 may be provided on the cross beam 2, so that users can hang the clothing that need care on the clothing hangers 7. When the clothing care apparatus is running, the cross beam 2 can reciprocate left and right, and the clothing hung on the cross beam 2 can be shaken with the left and right movement of the cross beam 2, thus facilitating removal of wrinkles on the clothing.

With continued reference to FIGS. 2 to 4, the driving member 3 is installed on the fixing bracket 11, and the driving member 3 is preferably a motor. A housing of the motor is fixedly connected with the fixing bracket 11, and an output shaft of the motor is fixedly connected with the cam 4. The motor can drive the cam 4 to rotate.

With continued reference to FIGS. 2 to 4, the sliding member 5 is provided with a receiving groove 53. In an installed state, the cam 4 is located in the receiving groove 53, and the receiving groove 53 matches with the cam 4. After the motor is started, the cam 4 can rotate in the receiving groove 53. In addition, during the rotation of the cam 4, the cam 4 always abuts against a side wall of the receiving groove 53, so that the sliding member 5 can be driven to reciprocate. The sliding member 5 is fixedly connected with the cross beam 2. When the motor is running, the cross beam 2 can reciprocate with the sliding member 5.

With continued reference to FIGS. 2 to 4, the guide members 6 are fixedly connected with the fixing bracket 11. When the sliding member 5 reciprocates, the guide members 6 can guide the sliding member 5 so that the sliding member 5 can move linearly. In this way, when the motor is running, the sliding member 5 can only reciprocate left and right linearly without swinging back and forth, so that the clothing hangers 7 arranged on the cross beam 2 can be prevented from hitting the back plate of the cabinet 1 and the door arranged on the front side of the cabinet 1.

As compared with the clothing shaking device disclosed in Chinese patent publication No. CN210420649U, the clothing shaking device of the present disclosure does not have a quick return phenomenon during operation, has better stability, longer service life, does not generate large noise, and has a better user experience.

As to the clothing vibrating device disclosed in Chinese patent publication No. CN103510357A, the slider in the patent needs to realize reciprocating movement by means of an elastic reset mechanism. During operation, the slider will continuously impact the elastic reset mechanism. After a period of use, the elastic reset mechanism will be prone to failure. However, in the clothing shaking device of the present disclosure, by providing the receiving groove 53 matching with the cam 4 on the sliding member 5 and placing the cam 4 in the receiving groove 53, the cam 4 can always abut against the side wall of the receiving groove 53 during the rotation of the cam 4, so as to drive the sliding member 5 to reciprocate. There is no risk of failure of the elastic reset mechanism, the reliability is better, and the service life is longer.

With continued reference to FIG. 3, the cam 4 is provided with the hollow part 41. By providing the hollow part 41 on the cam 4, the weight of the cam 4 can be effectively reduced, which is advantageous for the high-speed rotation of the cam 4. In this way, a shaking strength of clothing can be increased and the wrinkle removal effect can be improved. The cam 41 is provided with a connecting shaft 42, which is fixedly connected with the output shaft of the motor. In addition, the cam 4 is preferably an eccentric wheel, which has a simple structure and a low cost.

With continued reference to FIGS. 3 and 4, the sliding member 5 includes the sliding ring 51 and two sliding columns 52. The two sliding columns 52 are respectively arranged on both sides of the sliding ring 51 in the direction of reciprocating movement. The inner side walls of the sliding ring 51 enclose the receiving groove 53. The eccentric wheel is arranged in the sliding ring 51, and the sliding columns 52 are slidably connected with the guide members 6. When the eccentric wheel drives the sliding ring 51 to reciprocate, the guide members 6 match with the sliding columns 52, so that the sliding ring 51 and the sliding columns 52 can only move linearly.

The inner side walls of the sliding ring 51 enclose an oblong hole structure, and the eccentric wheel abuts against an inner side wall in a width direction of the oblong hole structure. It should be pointed out that in a strict sense, the oblong hole structure has a rectangular hole and two standard semicircular holes, and the two semicircular holes are arranged at both ends of the rectangular hole. However, the oblong hole structure of the present disclosure is not limited to the oblong hole in the strict sense; for example, the two ends of the rectangular hole can also be arc segments, etc. Of course, the inner side walls of the sliding ring 51 can also enclose a rectangular hole structure, and the eccentric wheel can abut against an inner side wall in a width direction of the rectangular hole structure.

With continued reference to FIG. 4, when the eccentric wheel rotates in the sliding ring 51, it always abuts against a left inner side wall or a right inner side wall of the sliding ring 51. Specifically, the motor drives the eccentric wheel to rotate clockwise, and as shown in drawing a in FIG. 4, the eccentric wheel abuts against the right inner side wall of the sliding ring 51 at this point and drives the sliding ring 51 to move to the right. When the eccentric wheel rotates by 90 degrees, as shown in drawing b in FIG. 4, the eccentric wheel still abuts against the right inner side wall of the sliding ring 51 at this point, and continues to drive the sliding ring 51 to move to the right. When the eccentric wheel rotates by 180 degrees, as shown in drawing c in FIG. 4, the eccentric wheel abuts against the left inner side wall of the sliding ring 51 at this point, and starts to drive the sliding ring 51 to move to the left. When the eccentric wheel rotates by 270 degrees, as shown in drawing d in FIG. 4, the eccentric wheel still abuts against the left inner side wall of the sliding ring 51 at this point, and continues to drive the sliding ring 51 to move to the left. After the eccentric wheel rotates by 360 degrees, it returns to the position shown in drawing a, thus completing a cycle.

With continued reference to FIGS. 2 and 3, the guide members 6 are of a plate structure, on which guide holes 61 matching with the sliding columns 52 are arranged, and the sliding columns 52 can slide left and right in the guide holes 61.

With continued reference to FIG. 2, the cross beam 2 is provided with two connecting columns 21, and top ends of the two connecting columns 21 are fixedly connected with the two sliding columns 52 respectively.

Hitherto, the technical solutions of the present disclosure have been described in connection with the preferred embodiments shown in the accompanying drawings, but it is easily understood by those skilled in the art that the scope of protection of the present disclosure is obviously not limited to these specific embodiments. Without departing from the principles of the present disclosure, those skilled in the art can make equivalent changes or replacements to relevant technical features, and all the technical solutions after these changes or replacements will fall within the scope of protection of the present disclosure.

What is claimed is:

1. A clothing shaking device for a clothing care apparatus, the clothing care apparatus comprising a cabinet and a fixing bracket arranged in the cabinet, and the clothing shaking device being configured to be arranged in the cabinet, wherein the clothing shaking device comprises:

a cross beam, which is configured to be movably connected with the fixing bracket and which is configured to carry clothing hangers or which is provided with clothing hangers;

a driving member configured to be installed on the fixing bracket;

a cam, which is fixedly connected with a power output end of the driving member;

a sliding member, which is provided with a receiving groove matching with the cam, and which is connected with the cross beam; and two guide members, which are configured to be fixedly connected with the fixing bracket and can guide the sliding member so that the sliding member can move linearly;

wherein the receiving groove is arranged to allow the cam to rotate in the receiving groove, and during the rotation of the cam, the cam always abuts against an inner side wall of a sliding ring, thus driving the sliding member to reciprocate through the rotation of the cam, and thus driving the cross beam to reciprocate;

wherein the sliding member comprises:

the sliding ring, inner side walls of which enclose the receiving groove; and two sliding columns, which are respectively arranged on both sides of the sliding ring in a direction of the reciprocating movement, and each of which is slidingly connected with one of the guide members; and wherein the cross beam is provided with two connecting columns, and the two connecting columns are fixedly connected with the two sliding columns respectively so that each of the guide members is slidingly connected with one of the sliding columns between the two connecting columns.

2. The clothing shaking device according to claim 1, wherein the inner side walls of the sliding ring enclose a rectangular hole structure, and the cam abuts against an inner side wall in a width direction of the rectangular hole structure.

3. The clothing shaking device according to claim 1, wherein the inner side walls of the sliding ring enclose an oblong hole structure, and the cam abuts against an inner side wall in a width direction of the oblong hole structure.

4. The clothing shaking device according to claim 1, wherein the guide members are of a plate structure, on which guide holes matching with the sliding columns are arranged.

5. The clothing shaking device according to claim 1, wherein the cam is provided with a hollow part.

6. The clothing shaking device according to claim 1, wherein the cam is an eccentric wheel.

7. The clothing shaking device according to claim 1, wherein both ends of the cross beam are each provided with an elastic connecting arm, and the elastic connecting arms are configured to be fixedly connected with the fixing bracket.

8. A clothing care apparatus, comprising a cabinet, a fixing bracket arranged in the cabinet, and a clothing shaking device arranged in the cabinet, wherein the clothing shaking device comprises:

a cross beam, which is movably connected with the fixing bracket and which is configured to carry clothing hangers or which is provided with clothing hangers;

a driving member installed on the fixing bracket;

a cam, which is fixedly connected with a power output end of the driving member;

a sliding member, which is provided with a receiving groove matching with the cam, and which is connected with the cross beam; and two guide members, which are fixedly connected with the fixing bracket and can guide the sliding member so that the sliding member can move linearly;

wherein the receiving groove is arranged to allow the cam to rotate in the receiving groove, and during the rotation of the cam, the cam always abuts against an inner side wall of a sliding ring, thus driving the sliding member to reciprocate through the rotation of the cam, and thus driving the cross beam to reciprocate;

wherein the sliding member comprises:

the sliding ring, inner side walls of which enclose the receiving groove; and two sliding columns, which are respectively arranged on both sides of the sliding ring in a direction of the reciprocating movement, and each of which is slidingly connected with one of the guide members; and wherein the cross beam is provided with two connecting columns, and the two connecting columns are fixedly connected with the two sliding columns respectively so that each of the guide members is slidingly connected with one of the sliding columns between the two connecting columns.

* * * * *